US008196322B2

(12) United States Patent
Atsumi et al.

(10) Patent No.: US 8,196,322 B2
(45) Date of Patent: Jun. 12, 2012

(54) ARTICLE OF FOOTWEAR WITH BALL CONTROL PORTION

(75) Inventors: Motoki Atsumi, Portland, OR (US); Andrew Caine, Portland, OR (US); John Droege, Portland, OR (US); David Eyre, Portland, OR (US); Paul Hooper, Vancouver, WA (US); Tetsuya Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 437 days.

(21) Appl. No.: 12/474,852

(22) Filed: May 29, 2009

(65) Prior Publication Data

US 2010/0299967 A1 Dec. 2, 2010

(51) Int. Cl.
*A43B 5/02* (2006.01)
*A43B 7/08* (2006.01)
*A43B 23/02* (2006.01)

(52) U.S. Cl. ..... 36/133; 36/3 B; 36/45; 36/50.1

(58) Field of Classification Search ..... 36/133, 36/3 B, 128, 45
See application file for complete search history.

(56) References Cited

U.S. PATENT DOCUMENTS

| | | | | |
|---|---|---|---|---|
| 1,469,766 | A | 10/1923 | Blair | |
| 1,559,114 | A | 10/1925 | Maranville | |
| 2,187,430 | A | 1/1940 | Olmsted at al. | |
| 2,350,879 | A * | 6/1944 | Daniels | 36/45 |
| 3,091,871 | A * | 6/1963 | Tronche | 36/72 R |
| 3,649,967 | A | 3/1972 | Millman | |
| 4,084,265 | A | 4/1978 | Anfelt | |
| 4,452,289 | A | 6/1984 | Smith | |
| 4,577,625 | A | 3/1986 | Lohati et al. | |
| 4,825,552 | A | 5/1989 | Bendickson et al. | |
| 4,893,519 | A | 1/1990 | Corso et al. | |
| 4,951,533 | A | 8/1990 | Hillinger | |
| 5,056,945 | A | 10/1991 | Klodt | |
| D323,217 | S | 1/1992 | Holden | |
| D347,709 | S | 6/1994 | Pearson | |
| 5,419,014 | A | 5/1995 | Piantedosi | |
| 5,491,015 | A | 2/1996 | Reeves et al. | |
| 5,500,956 | A | 3/1996 | Schulkin et al. | |
| 5,572,739 | A | 11/1996 | Kolada et al. | |
| 6,099,936 | A | 8/2000 | Kashihara | |
| 6,647,549 | B2 | 11/2003 | McDevitt et al. | |
| 7,155,846 | B2 * | 1/2007 | Alfaro et al. | 36/136 |
| 2002/0029496 | A1 | 3/2002 | Morle | |
| 2004/0088888 | A1 * | 5/2004 | Johnston | 36/133 |

(Continued)

FOREIGN PATENT DOCUMENTS

DE 2721410 11/1978

(Continued)

OTHER PUBLICATIONS

International Search Report and Written Opinion mailed Mar. 15, 2011 in International Application No. PCT/US2010/034821.

(Continued)

*Primary Examiner* — Ted Kavanaugh
(74) *Attorney, Agent, or Firm* — Plumsea Law Group, LLC

(57) ABSTRACT

A ball control portion for an article of footwear is disclosed. The ball control portion includes a plurality of protrusions that are configured to bend to provide increased surface contact between an upper and a ball, such as a soccer ball. The plurality of protrusions are arranged in an arc-like configuration on the upper that generally corresponds to the curvature of a ball.

20 Claims, 7 Drawing Sheets

U.S. PATENT DOCUMENTS

| | | | | |
|---|---|---|---|---|
| 2005/0016023 | A1 | 1/2005 | Burris | |
| 2006/0218821 | A1* | 10/2006 | Hatzilias | 36/133 |
| 2009/0113766 | A1* | 5/2009 | Hooper | 36/133 |

FOREIGN PATENT DOCUMENTS

| | | |
|---|---|---|
| EP | 1430801 | 6/2004 |
| JP | 63256704 | 10/1988 |
| JP | 9209206 | 8/1997 |
| JP | 9253266 | 9/1997 |

OTHER PUBLICATIONS

International Preliminary Report on Patentability (including Written Opinion of the ISA) mailed Dec. 8, 2011 in International Application No. PCT/US2010/034821.

* cited by examiner

ARTICLE OF FOOTWEAR WITH BALL CONTROL PORTION

BACKGROUND

The present invention relates generally to an article of footwear, and in particular to an article of footwear with a ball control portion.

Maranville (U.S. Pat. No. 1,559,114) teaches a series of nubs that are arranged in a generally oval configuration in several areas on a rubber glove to increase grip. Kolada (U.S. Pat. No. 5,572,739) teaches a baseball glove that includes protrusions made of an elastomeric material that improve a user's grip on a ball that is caught.

Smith (U.S. Pat. No. 4,452,289) teaches a hand tool with tread means. The tread means are arranged in rows. Smith teaches that the handle has advantageous hand "feel" since the outer body has sufficient pliability to conform to the shape and size of the palm.

SUMMARY

In one aspect, the invention provides An article of footwear, comprising: an upper including a ball control portion; the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a gripping portion that extends in a direction along the major axis and in a direction along the normal axis; and where the plurality of protrusions are disposed in an arc-like configuration.

In one aspect, the invention provides An article of footwear, comprising: an upper including a ball control portion; the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a gripping portion that extends in a direction along the major axis and in a direction along the normal axis; and where the plurality of protrusions are configured to bend in a manner so that the gripping portions confront a surface of a ball during a kick.

In one aspect, an article of footwear, comprising: an upper including a ball control portion; the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a gripping portion that extends in a direction along the major axis and in a direction along the normal axis; and where the major axis of some protrusions of the plurality of protrusions is aligned with a curve on a surface of a ball when the ball control portion contacts the ball during a kick.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
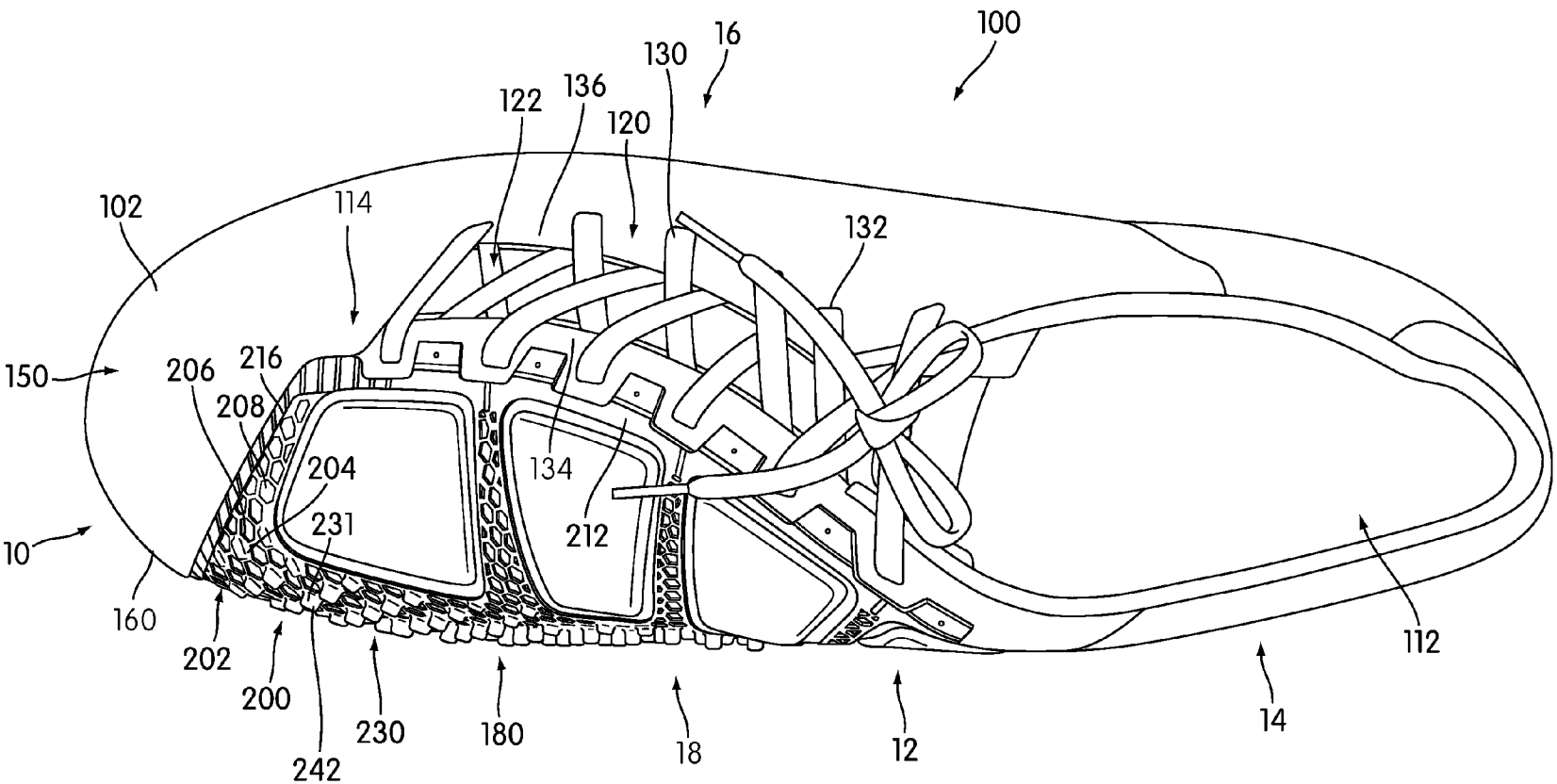
FIG. 1 is a top down view of an embodiment of an article of footwear including a ball control portion.
Figure 2:
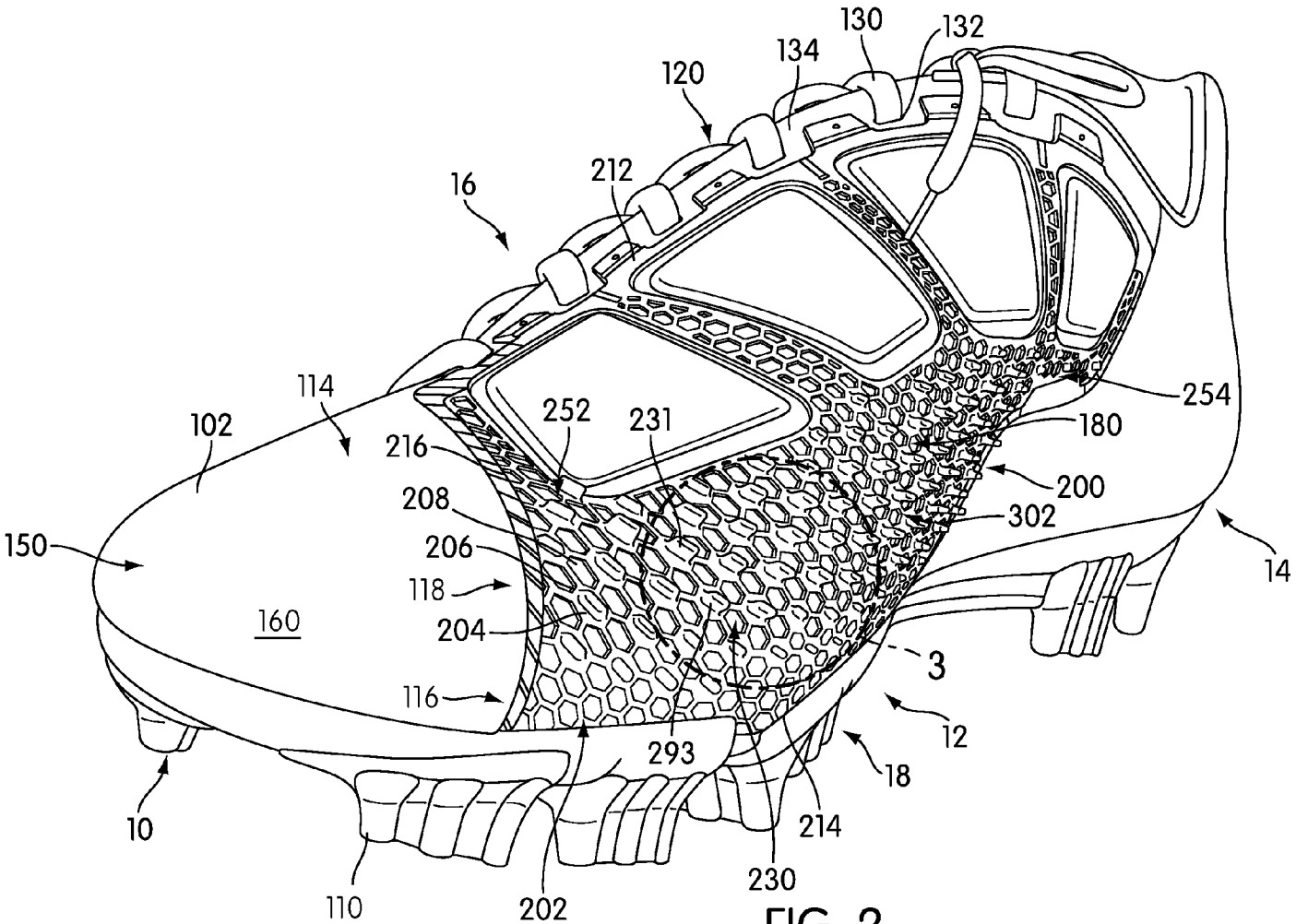
FIG. 2 is an isometric view of an embodiment of a medial side of an article of footwear including a ball control portion.

FIGS. 1 and 2 illustrate an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 and 2, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 and 2, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

Article 100 can include an upper 102 and sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Upper 102 can include various portions. In one embodiment, upper 102 can include vamp portion 114. In addition, upper 102 can include lower portion 116 that is disposed adjacent to sole structure 110. Also, upper 102 can include sidewall portion 118 that is disposed between vamp portion 114 and lower portion 116.

Article 100 can include lacing system 120. In some cases, lacing system 120 can include medial lacing edge 134 and lateral lacing edge 136 that are separated by lacing gap 122. In particular, lacing gap 122 may extend from throat 112 of upper 102 towards forefoot portion 10. In addition, lacing gap 122 may be associated with lacing holes 132 that are disposed on medial lacing edge 134 and lateral lacing edge 136. Furthermore, lacing gap 122 may be further associated with lace 130 that may be disposed through lacing holes 132. With this arrangement, lace 130 may be used to tighten upper 102 around a foot.

In different embodiments, the shape of lacing gap 122 can vary. In some cases, lacing gap 122 may have a substantially straight shape. In other cases, lacing gap 122 may have a curved shape. In one embodiment, lacing gap 122 may be shaped to curve towards lateral side 16 from throat 112. In other words, lacing gap 122 may be arranged in an asymmetric manner on upper 102.

An article of footwear can include provisions for enhancing traction of an upper for purposes of better ball control during kicks. In some cases, an upper can include portions comprising a material that has a high coefficient of friction to provide better grip on a ball during kicks. In other cases, an upper can include structural features on an upper to help enhance friction. For example, in some cases, an upper can include structural features that are intended to increase surface area at a point of contact of the ball which can help enhance traction between the upper and the ball.

In one embodiment, upper 102 can include ball control portion 200. In this embodiment, ball control portion 200 may extend through portions of medial side 18 of upper 102. For example, in the current embodiment ball control portion 200 may extend from medial lacing edge 134 to sole structure 110 in a generally lateral direction. In some cases, ball control portion 200 may extend from forefoot portion 10 to heel portion 14 in a generally longitudinal direction. In particular, front edge 216 of ball control portion 200 may be disposed adjacent to toe portion 150 of upper 102. In addition, in some cases, first lateral edge 212 of ball control portion 200 may be disposed adjacent to medial lacing edge 134. Also, second lateral edge 214 may be disposed adjacent to sole structure 110 at forefoot portion 10. Furthermore, second lateral edge 214 may rise away from sole structure 110 at midfoot portion 10 and at heel portion 14.

Figure 3:
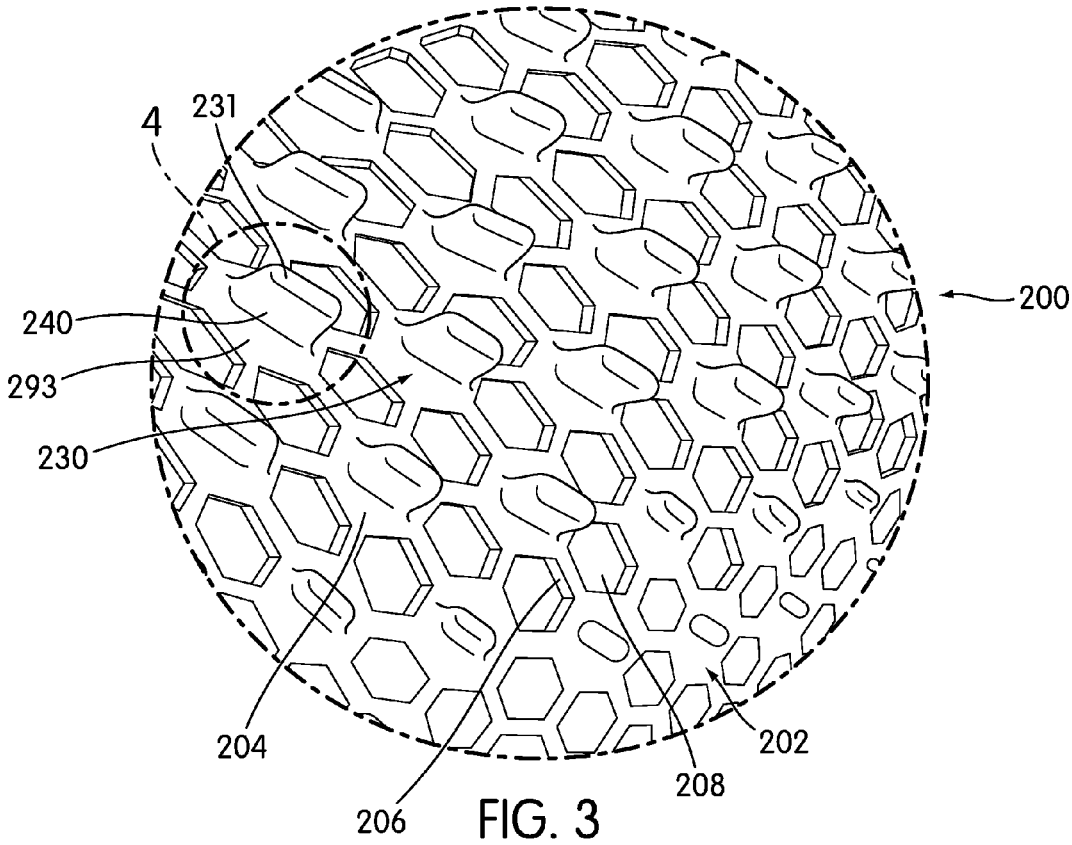
FIG. 3 is an enlarged view of an embodiment of a ball control portion.

FIG. 3 illustrates an isometric enlarged view of a portion of ball control portion 200. Referring now to FIGS.1 through 3, in some embodiments, ball control portion 200 can include base portion 202. Generally, base portion 202 may be a layer of material that is applied to upper 102. In some cases, base portion 202 may comprise a contoured layer that generally conforms to the contours of medial side 18 of upper 102. In other cases, base portion 202 may be an initially flat layer that is stretched or otherwise wrapped over the contoured surface of upper 102.

In different embodiments, the structure of base portion 202 can vary. In some cases, base portion 202 may comprise a substantially uniform layer. In other cases, base portion 202 may comprise a non-uniform layer. In the current embodiment, base portion 202 may comprise a substantially webbed layer including connecting members that are spaced apart by gaps.

In one embodiment, base portion 202 may comprise hub portions 204. Hub portions 204 can be connected to one another by connecting members 206. Furthermore, hub portions 204 and connecting members 206 may be spaced apart by gaps 208. This arrangement may provide a web-like configuration for base portion 202. In other embodiments, however, base portion 202 could comprise a substantially solid layer without gaps.

In different embodiments, hub portions 204 can have varying shapes. In some cases, hub portions 204 may have substantially similar shapes to one another. In other cases, different hub portions of hub portions 204 can have substantially different shapes. In the current embodiment, hub portions 204 may all be configured with substantially hexagonal shapes. In other embodiments, however, hub portions 204 could be associated with any other types of shapes including, but not limited to: rounded shapes (such as circular or oval shapes), polygonal shapes (such as triangular, rectangular, pentagonal, etc.), regular shapes, irregular shapes, or any other types of shapes.

In different embodiments, gaps 208 could have varying shapes. In some cases, gaps 208 may have substantially similar shapes to one another. In other cases, different gaps of gaps 208 can have substantially different shapes. Furthermore, in some cases, gaps 208 may have shapes that correspond to the shapes of hub portions 204. In other cases, however, gaps 208 may have different shapes from hub portions 204. In the current embodiment, gaps 208 may have substantially hexagonal shapes that correspond to the shapes of hub portions 204. In other embodiments, however, gaps 208 could have any other shapes including any of the shapes discussed above.

Using the arrangement discussed above, the structural properties of base portion 202 can be varied. For example, by varying the size, shape and number of gaps in base portion 202, the rigidity of base portion 202 can be varied. In addition, by increasing the number of gaps, and thus decreasing the material comprising base portion 202, the overall weight of base portion 202 can be reduced to help minimize additional weight on upper 102.

A ball control portion can include provisions for increasing grip between an upper and a ball. In one embodiment, ball control portion 200 can include plurality of protrusions 230. Generally, plurality of protrusions 230 can be any type of protrusions that extend outwards from outer surface 160 of upper 102. In different embodiments, plurality of protrusions 230 can be configured in various ways. For example, in some cases, plurality of protrusions 230 may be characterized as fin-like protrusions. In other cases, plurality of protrusions 230 may be characterized as flap-like protrusions. In this embodiment, plurality of protrusions 230 may be characterized as fin-like protrusions.

In different embodiments, plurality of protrusions 230 can be associated with different portions of base portion 202. In some cases, plurality of protrusions 230 can be disposed on connecting members 206. In other cases, plurality of protrusions 230 can be disposed on hub portions 204. In an exemplary embodiment, plurality of protrusions 230 can be disposed on hub portions 204. For example, plurality of protrusions 230 may include first protrusion 231 that is disposed on first hub portion 293.

For purposes of characterizing the size, geometry and/or orientation of a protrusion, each protrusion discussed in this detailed description and in the claims may be associated with a set of axes that are defined relative to each protrusion. The term "major axis" as used throughout this detailed description and in the claims refers to an axis extending through a length of a protrusion. The term "minor axis" as used throughout this detailed description and in the claims refers to an axis extending through a width of a protrusion. Furthermore, the term "normal axis" as used throughout this detailed description and in the claims refers to a direction extending through a height of the protrusion, which is generally perpendicular (or normal) to a plane formed between the major axis and the minor axis. It should be understood that these axes are defined locally with respect to an individual protrusion so that a major axis of one protrusion may not be coincident with a major axis of another protrusion.

Figure 4:
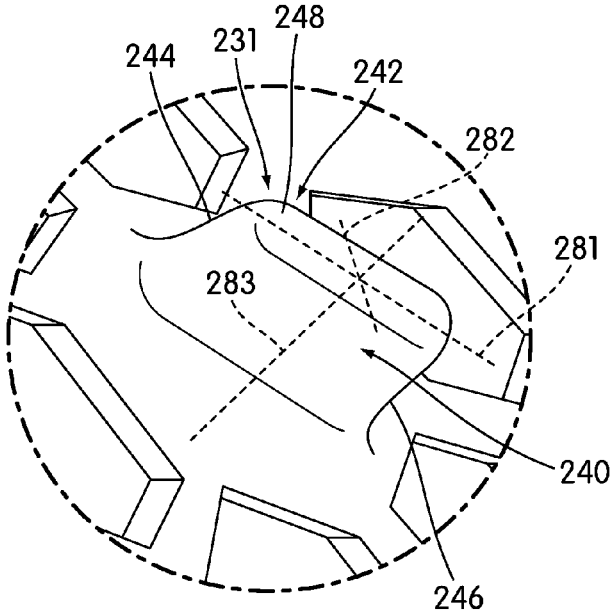
FIG. 4 is an enlarged view of an embodiment of a protrusion associated with a ball control portion.

FIG. 4 illustrates an isolated view of first protrusion 231 for purposes of illustrating the geometry of plurality of protrusions 230. Referring to FIG. 4, for purposes of description, first protrusion 231 may be associated with major axis 281, minor axis 282 and normal axis 283 in the manner described above. In some cases, first protrusion 231 includes first gripping portion 240 and second gripping portion 242 (see FIG. 1), which is disposed opposite of first gripping portion 240. First gripping portion 240 and second gripping portion 242 may form sidewalls for first protrusion 231. In particular, first gripping portion 240 and second gripping portion 242 are approximately planar surfaces that extend along major axis 281 and normal axis 283 of first protrusion 231. In other embodiments, however, first gripping portion 240 and second gripping portion 242 can be substantially curved surfaces.

First protrusion 231 can also include first side edge 244 and second side edge 246 that extend along minor axis 282 between first gripping portion 240 and second gripping portion 242. In some cases, first side edge 244 and second side edge 246 can be approximately planar edges. In other cases, however, first side edge 244 and second side edge 246 can be approximately rounded edges. In addition, first protrusion 231 can include top surface 248 that extends along major axis 281 and minor axis 282 at an outward most end of first protrusion 231. In some cases, top surface 248 may be an approximately planar top surface that presents a flat end for first protrusion 231. In other cases, however, top surface 248 may be a rounded surface.

In different embodiments, the dimensions of first protrusion 231 can vary. In an exemplary embodiment, the length of first protrusion 231, which is associated with major axis 281, may be substantially larger than the width, which is associated with minor axis 282. Likewise, the height of first protrusion 231, which is associated with normal axis 283, may be substantially larger than the width. Still further, the length may be substantially larger than the height. With this arrangement for the dimensions of first protrusion 231, first gripping portion 240 and second gripping portion 242 may comprise a majority of the surface area of first protrusion 231.

In some embodiments, first protrusion 231 may be configured to bend. In some cases, first protrusion 231 may be configured to bend about an axis approximately parallel to major axis 281. In other words, first protrusion 231 may be configured to bend in a manner that disposes either first gripping portion 240 or second gripping portion 242 closer to outer surface 160 of upper 102. For example, in one direction of bending, second gripping portion 242 may approximately confront base portion 202. Furthermore, in this case, first gripping portion 240 may be oriented to face outwardly and away from upper 102. In addition, in a second direction of bending, first gripping portion 240 may approximately confront base portion 202. Furthermore, in this case, second gripping portion 242 may be oriented to face outwardly and away from upper 102. With this arrangement, as first protrusion 231 bends, either first gripping portion 240 or second gripping portion 242 are exposed outwardly on outer surface 160 of upper 102. This arrangement can increase the surface area of first protrusion 231 that is exposed outwardly on upper 102, which can help increase grip on a ball during kicks, for example.

It will be understood that the discussion above for first protrusion 231 may be applied to any protrusion of plurality of protrusions 230. In other words, the general geometry of each protrusion of plurality of protrusions 230 may be substantially similar to the geometry described for first protrusion 231. In addition, each protrusion of plurality of protrusions 230 may be provided with at least one gripping portion that is configured to contact a ball. Furthermore, each protrusion can be configured to bend in a similar manner about a major axis of the protrusion so as to expose a gripping portion outwardly on upper 102.

A ball control portion including protrusions can include provisions for improving contact with a ball during kicks. In some embodiments, protrusions can be selectively applied to regions of an upper that impact a ball during various types of kicks. In one embodiment, protrusions can be selectively applied to a predetermined kicking region of an upper. The term "predetermined kicking region" as used throughout this detailed description and in the claims refers to a region of an article that is configured to impact a ball during a predetermined type of kick. For example, in a free kick situation in soccer, a player may want to put sidespin on the ball in order to curve the trajectory of the ball. This type of kick is often referred to as a "banana kick," and is useful for kicking the ball at a target that is on the other side of an obstruction, such as an opposing player. In order to apply sidespin to the ball, the play may kick the ball off center using the medial side, or instep of the upper. Therefore, in some embodiments, a ball control portion can include protrusions that are disposed on the instep of the upper to facilitate a kick in which sidespin is applied to the ball.

Referring to FIGS. 1 and 2, in the current embodiment, plurality of protrusions 230 may arranged on predetermined kicking region 180 of upper 102. In this case, predetermined kicking region 180 may be disposed on medial side 18 of sidewall portion 118 of upper 102. Furthermore, predetermined kicking region 180 may extend from toe portion 150 to midfoot portion 12 of upper 102. In the current embodiment, predetermined kicking region 180 may include the instep of upper 102 as well as adjacent areas to the instep. With this arrangement, plurality of protrusions 230 may be disposed on portions of upper 102 that are most likely to contact a ball during a medial side kick.

Protrusions of a ball control portion can be oriented in a manner that increases the contact area between the protrusions and a rounded surface such as a ball. In some embodiments, protrusions can be arranged in a curved configuration that corresponds to the natural curvature of a ball surface, which is approximately spherical. In one embodiment, plurality of protrusions 230 can be aligned in an arc-like configuration. The term "arc" as used throughout this detailed description and in the claims refers to any segment of a curve. In some cases, an arc could be a segment of a circle. In other cases, however, an arc could be a segment of any other type of curve.

In one embodiment, plurality of protrusions 230 can be arranged in arc-like configuration 302. In particular, first group of protrusions 252 of plurality of protrusions 230, which are disposed in forefoot portion 10, may be oriented in a first direction. Also, second group of protrusions 254 of plurality of protrusions 230, which are disposed in midfoot portion 12, may be oriented in a second direction. In other words, the major axis of each protrusion associated with first group of protrusions 252 may be oriented approximately in a first direction. Likewise, the major axis of each protrusion associated with second group of protrusions 254 may be oriented approximately in a second direction. It will be understood that the first direction and the second direction are only intended to indicate average directions. In particular, although the major axis of each protrusion of first group of protrusions 252 may be oriented in slightly different directions from one another, the first direction may characterize the overall direction, or average direction, of the protrusions of first group of protrusions 252. Similarly, although the major axis of each protrusion of second group of protrusions 254 may be oriented in slightly different directions from one another, the second direction may characterize the overall direction, or average direction, of the protrusions of second group of protrusions 254. Still further, the protrusions disposed between first group of protrusions 252 and second group of protrusions 254 may be oriented in a manner that continuously varies between the first direction and the second direction.

In some cases, the first direction may be substantially similar to the second direction. In other cases, however, the first direction may be a substantially different direction than the second direction. For example, in one embodiment, the first direction may be a direction oriented close to a lateral direction, while the second direction may be a direction oriented close to a longitudinal direction.

In some embodiments, arc-like configuration 302 may have a configuration that corresponds to the curvature of a generally spherical ball. For example, in one embodiment, arc-like configuration 302 may correspond to the curvature of a soccer ball. In particular, the shape and size of arc-like configuration 302 may be selected so that as a ball contacts predetermined kicking region 180, plurality of protrusions 230 may be substantially tangent to an outer surface of the ball. It will be understood that in other embodiments, arc-like configuration 302 can correspond to the shapes of different shapes and/or sizes of balls. For example, in another embodiment, arc-like configuration 302 could have a size and shape that correspond to the curvature of a football that is used in American football. In still another embodiment, arc-like configuration 302 can have a size and shape that corresponds to the curvature of a ball that is used in rugby.

In will be understood that arc-like configuration 302 is only intended to approximate the configuration of plurality of protrusions 230. In some cases, plurality of protrusions 230 may be associated with individual arcs that extend over a portion of ball control portion 200. For example, in one embodiment, plurality of protrusions 230 may be arranged on adjacent arcs that extend from vamp portion 114 and lower portion 116 of upper 102.

Article 100 may be made from materials known in the art for making articles of footwear. For example, sole structure 110 may be made from any suitable material, including, but not limited to: elastomers, siloxanes, natural rubber, other synthetic rubbers, aluminum, steel, natural leather, synthetic leather, or plastics. Also, an upper may be made from any suitable material, including, but not limited to: nylon, natural leather, synthetic leather, natural rubber or synthetic rubber.

In different embodiments, the materials used for a ball control portion including a plurality of protrusions can vary. In some embodiments, a base portion of a ball control portion and a plurality of protrusions disposed on the base portion can be made of a substantially similar material. For example, in one embodiment, a base portion and a plurality of protrusions, can be made of a substantially monolithic molded material. Examples of materials for making a ball control portion include, but are not limited to: elastomers, siloxanes, natural rubber, other synthetic rubbers as well as any other materials. In some cases, materials with relatively high coefficients of friction can be used to increase grip on a ball. In other embodiments, however, a plurality of protrusions could be made of a substantially different material than a base portion. For example, in another embodiment, a base portion of a ball control portion can be made of a material with a lower coefficient of friction than a material used for a plurality of protrusions.

Figure 5:
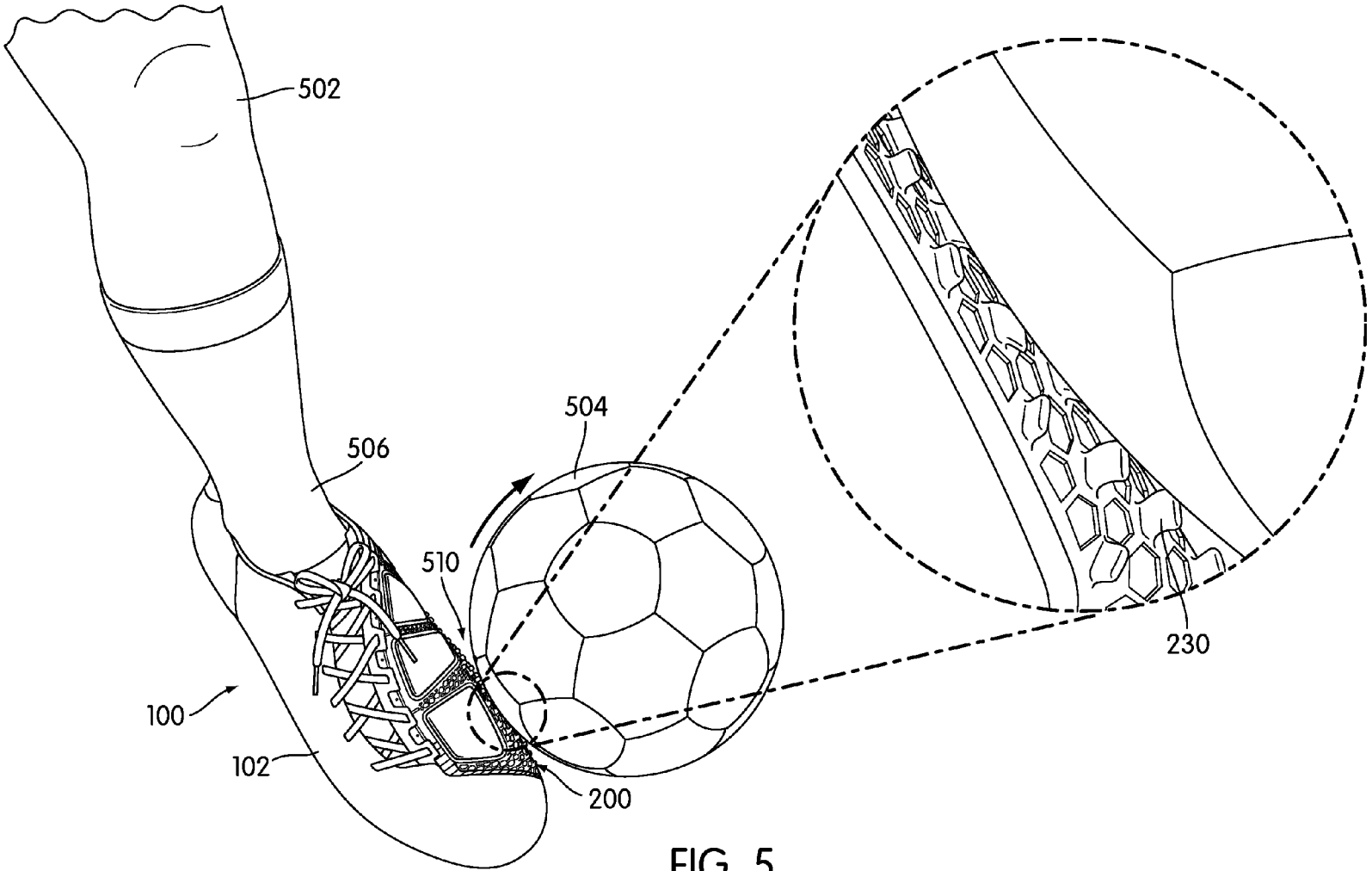
FIG. 5 is a view of an embodiment of a ball being kicked using a ball control portion.
Figure 6:
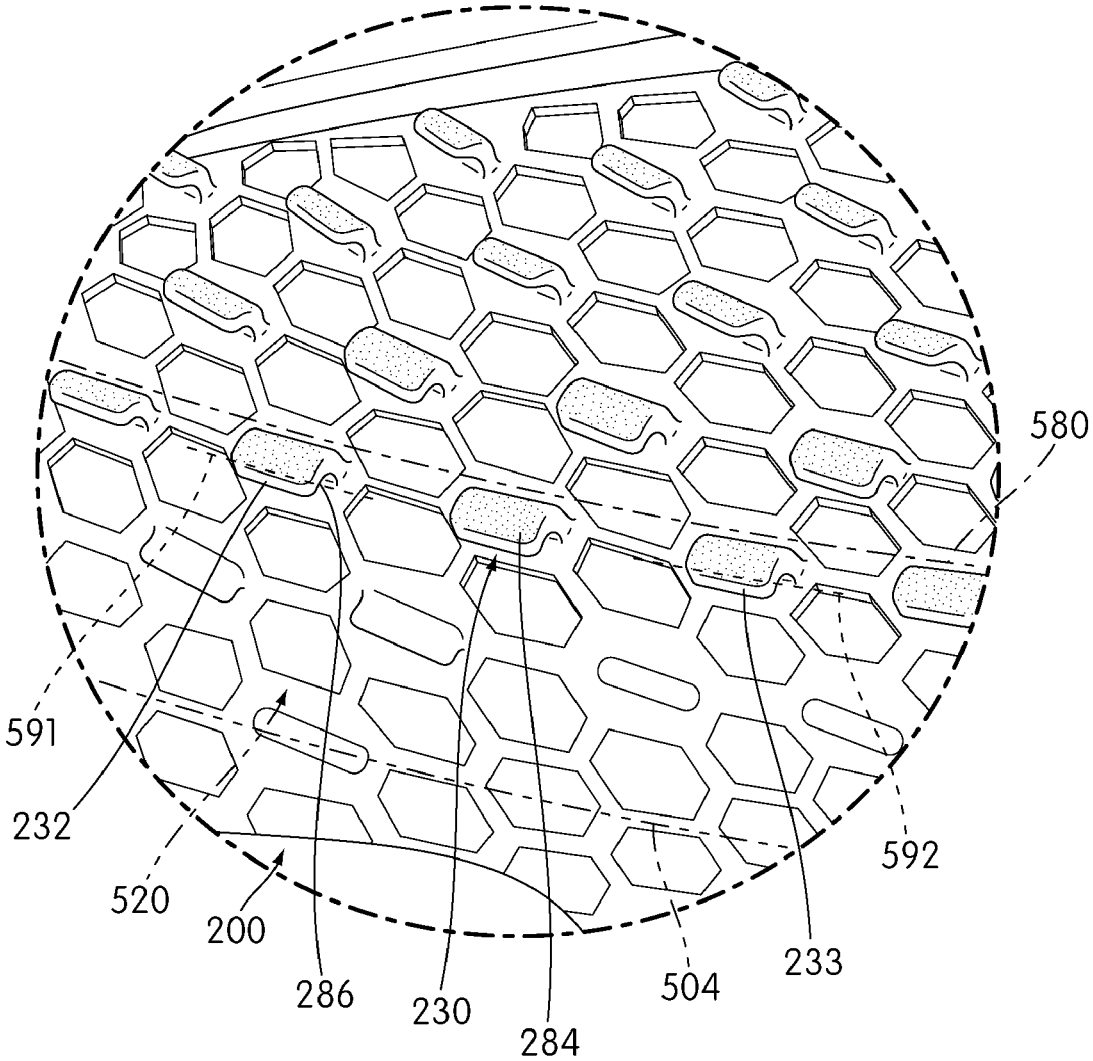
FIG. 6 is a schematic view of an embodiment of a plurality of protrusions deforming during contact with a ball.

FIGS. 5 and 6 illustrate an embodiment of athlete 502 kicking ball 504. In particular, athlete 502 is intending to kick ball 504 in a manner that imparts sidespin to ball 504 so that the trajectory of ball 504 may be curved. Although the current embodiment illustrates a kick preformed using a medial side of a right foot, in other embodiments athlete 502 may use the medial side of a left foot to perform a similar type of kick.

Referring to FIGS. 5 and 6, instep portion 510 of upper 102 may contact ball 504 several centimeters from a center position of ball 504. At this point, ball 504 may contact ball control portion 200. More specifically, ball 504 may contact plurality of protrusions 230 of ball control portion 200. Under the force of impact between upper 102 and ball 504, plurality of protrusions 230 may bend. In some embodiments, as the motion of foot 506 is sideways as well as vertically upwards, plurality of protrusions 230 may bend or deflect downwards in a manner that exposes first set of gripping portions 284 in an outward direction. Furthermore, second set of gripping portions 286 may be bent towards outer surface 160 of upper 102.

Because first set of gripping portions 284 are directed outwardly from upper 102, first set of gripping portions 284 may confront ball surface 520 of ball 504. Furthermore, because of the flexibility of plurality of protrusions 230, first gripping portions 284 may conform to ball surface 520 in a manner that maximizes the surface contact area between first set of gripping portions 284 and ball surface 520. In contrast to situations where a ball may only contact a small region of an upper, the current embodiment provides flexible protrusions that bend in a manner to create a greater surface contact area between upper 102 and ball 504.

In addition, as illustrated in FIG. 6, the curved arrangement of plurality of protrusions 230 in the current embodiment may correspond to the curvature of ball 504. In particular, plurality of protrusions 230 may be aligned with curve 580 of ball surface 520. Specifically, some of plurality of protrusions 230 may be aligned so that the major axis of each protrusion is aligned with curve 580. In this embodiment, for example, first major axis 591 of second protrusion 232 may be generally oriented along curve 580. Likewise, second major axis 592 of third protrusion 233 may be generally oriented along curve 580. This configuration may help increase the total number of protrusions of plurality of protrusions 230 that are in contact with ball surface 520.

This arrangement facilitates increased grip between ball control portion 200 and ball 504, as athlete 502 continues the kicking motion. In particular, the vertical component of the kicking motion is applied to ball surface 520 due to the enhanced grip provided by ball control portion 200. This arrangement acts to add rotation, or sidespin, to ball 504 as ball 504 is kicked forwards.

Because protrusions 230 are longer in one direction than they are the other, protrusions 230 may change characteristics depending on how the ball is kicked. The spin put on a ball by kicking at one angle may differ from the spin put on a ball by kicking at another angle. Further, because protrusions 230 provide a flexible and adaptable surface, protrusions 230 may adapt to accommodate a particular user and particular kinds of kicks.

Although the current embodiment discusses the use of plurality of protrusions 230 for applying side spin to a ball during a particular type of kick, in other embodiments plurality of protrusions 230 can be used to apply other types of spin to a ball as well. In particular, the orientation and location of a plurality of protrusions can be varied to facilitate applying different types of spin to a ball for different types of kicks. For example, in other cases, a plurality of protrusions can be used to apply sidespin, topspin, backspin as well as other types of spin to a ball. In addition, in other embodiments, a plurality of protrusions can be used to enhance grip between an upper and a ball for other purposes as well. For example, in another embodiment, a plurality of protrusions can help enhance grip between a ball and an upper for purposes of receiving or making a pass. In still another example, a plurality of protrusions can be used to enhance grip between a ball and an upper for purposes of performing special maneuvers such as bicycle kicks or heel kicks.

The current embodiment illustrates a ball control portion disposed on a medial side of an upper, however, in other embodiments a ball control portion comprising a plurality of protrusions could be associated with any other region of an upper, including any other predetermined kicking region that is associated with a predetermined type of kick. For example, in one embodiment, a ball control portion could be disposed on a lateral side of an upper for kicking a ball with a lateral side of the upper. In another embodiment, a ball control portion could be disposed on a heel portion of the upper for performing heel kicks or rainbow kicks.

Figure 7:
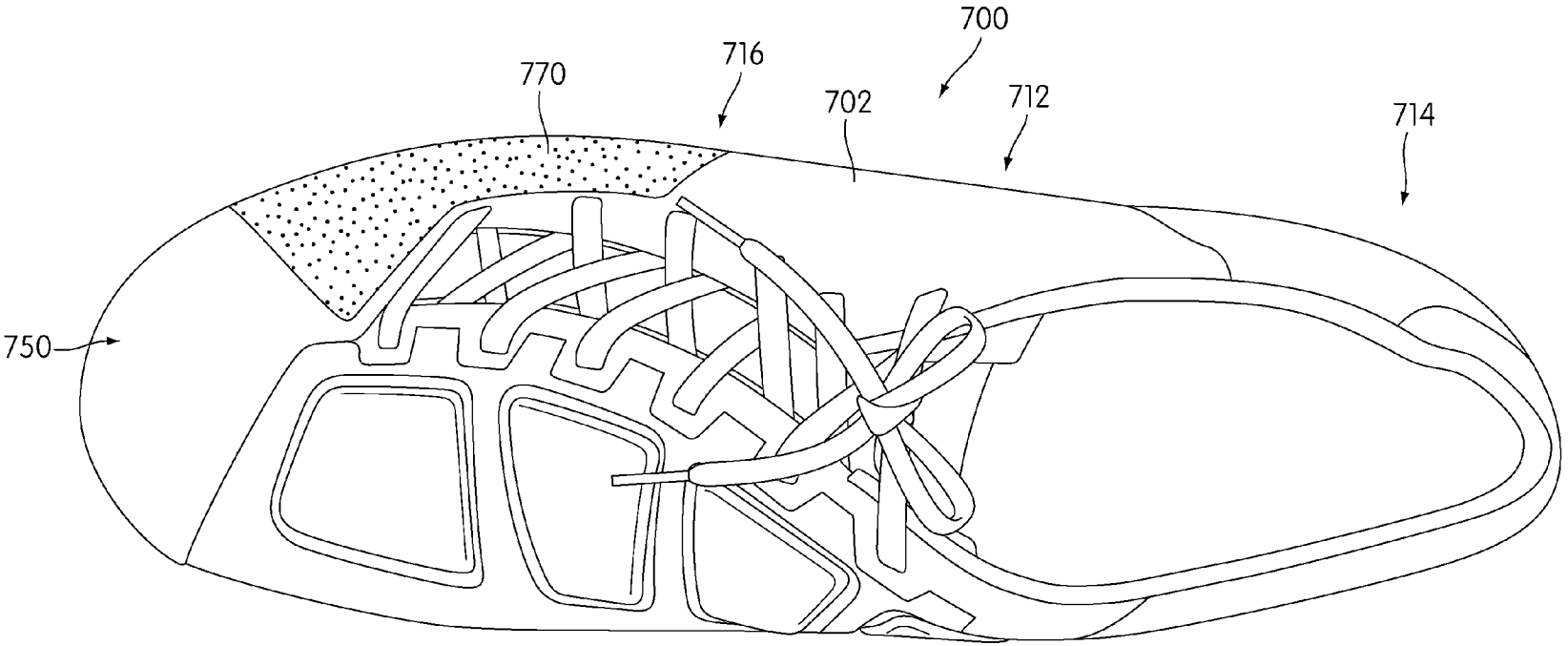
FIG. 7 is a schematic view of an embodiment of a ball control portion disposed on a lateral side of an upper.

FIG. 7 illustrates an alternative embodiment of article 700. Article 700 may be substantially similar to article 100 of the previous embodiment and includes, for example, upper 702. Article 700 further includes ball control portion 770. For purposes of clarity, ball control portion 770 is shown schematically in the current embodiment. In particular, the general location of ball control portion 770 is indicated in FIG. 7, but the details of ball control portion 770 are not illustrated. However, it will be understood that in various embodiments, ball control portion 770 may be configured in a similar manner to ball control portion 200 of the previous embodiment. In particular, ball control portion 770 may include a plurality of protrusions configured with gripping portions for contacting a ball.

In the current embodiment, ball control portion 770 may be disposed on lateral side 716 of upper 702. In some cases, ball control portion 770 may extend between toe portion 750 and midfoot portion 712 of upper 702. In other cases, however, ball control portion 770 may extend through different portions of lateral side 716. For example, in another embodiment, ball control portion 770 may extend through toe portion 750. In still another embodiment, ball control portion 770 may extend through heel portion 714.

It will be understood that in different embodiments, the arrangement of a plurality of protrusions of ball control portion 770 can vary. In an exemplary embodiment, the plurality of protrusions can be arranged in an arc-like configuration that corresponds to the curvature of a ball surface. In other embodiments, however, the plurality of protrusions can be arranged in any other configuration.

Figure 8:
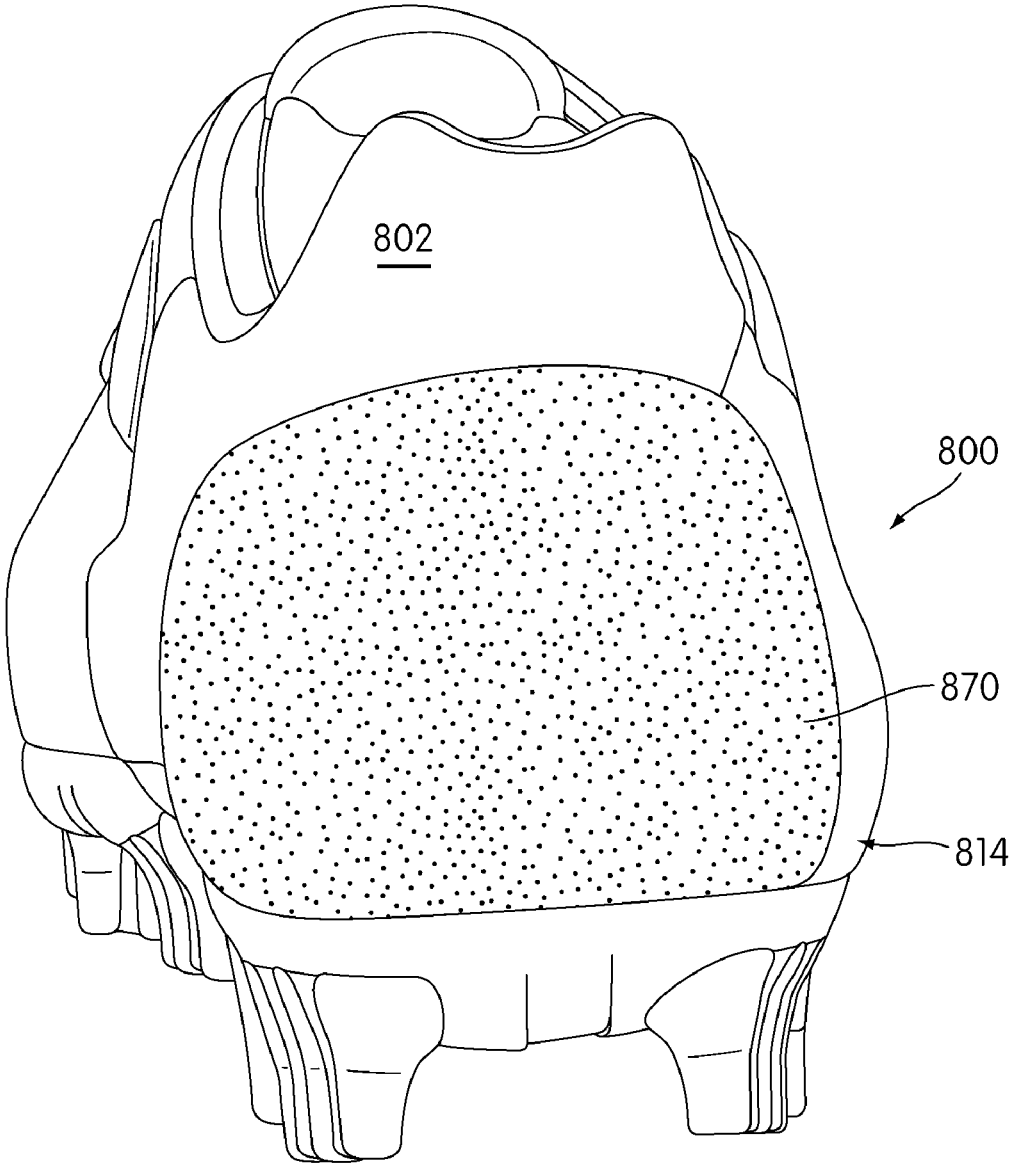
FIG. 8 is a schematic view of an embodiment of a ball control portion disposed on a heel portion of an upper.

FIG. 8 illustrates an alternative embodiment of article 800. Article 800 may be substantially similar to article 100 of the previous embodiment and includes, for example, upper 802. Article 800 further includes ball control portion 870. For purposes of clarity, ball control portion 870 is shown schematically in the current embodiment. In particular, the general location of ball control portion 870 is indicated in FIG. 8, but the details of ball control portion 870 are not illustrated. However, it will be understood that in various embodiments, ball control portion 870 may be configured in a similar manner to ball control portion 200 of the previous embodiment. In particular, ball control portion 870 may include a plurality of protrusions configured with gripping portions for contacting a ball.

In the current embodiment, ball control portion 870 may be disposed on heel portion 814 of upper 802. In some cases, ball control portion 870 may extend over a majority of heel portion 814. In other cases, however, ball control portion 870 may only extend through a lateral or medial side of heel portion 814. In still other cases, ball control portion 870 may extend through other portions of heel portion 814.

It will be understood that in different embodiments, the arrangement of a plurality of protrusions of ball control portion 870 can vary. In an exemplary embodiment, the plurality of protrusions can be arranged in an arc-like configuration that corresponds to the curvature of a ball surface. In other embodiments, however, the plurality of protrusions can be arranged in any other configuration.

Using the arrangements discussed above, a ball control portion can be configured to increase grip between a ball and various different regions of an upper. In particular, by applying a plurality of protrusions to selective regions of an upper corresponding to regions that impact a ball during predetermined types of kicks, a ball control portion can be used to enhance the ability of an athlete to apply spin for curving the trajectory of a ball. Still further, by arranging a plurality of protrusions in an arc-like configuration corresponding to the curvature of a ball, the grip between a ball and an upper can be enhanced for more precise control of the ball trajectory.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper including a ball control portion;

the ball control portion comprising a plurality of protrusions that are configured to bend;

each protrusion of the plurality of protrusions including a major axis, a minor axis, and a normal axis, the normal axis being approximately perpendicular to the major axis and the minor axis; and each protrusion of the plurality of protrusions further including a planar gripping portion that extends in a direction along the major axis and in a direction along the normal axis;

wherein the plurality of protrusions are disposed in an arc-like configuration along an arc;

wherein adjacent protrusions along the arc are arranged with the major axes of the adjacent protrusions in substantial alignment with each other; and wherein non-adjacent protrusions along the arc are arranged with the major axes of the non-adjacent protrusions in substantial non-alignment with each other.

2. The article of footwear according to claim 1, wherein a first group of protrusions of the plurality of protrusions associated with a forefoot portion of the upper are approximately oriented in a first direction, and wherein a second group of protrusions of the plurality of protrusions associated with a midfoot portion of the upper are approximately oriented in a second direction that is different from the first direction.

3. The article of footwear according to claim 2, wherein the upper is associated with a lateral direction oriented in a widthwise direction of the upper and a longitudinal direction oriented in a lengthwise direction of the upper, and wherein the first direction is close to the lateral direction.

4. The article of footwear according to claim 3, wherein the second direction is close to the longitudinal direction.

5. The article of footwear according to claim 1, wherein the upper includes a vamp portion, a lower portion and a sidewall portion disposed between the vamp portion and the lower portion, and wherein the plurality of protrusions are disposed on the sidewall portion of the upper.

6. The article of footwear according to claim 1, wherein the plurality of protrusions are oriented on a predetermined kicking region of the upper and wherein the predetermined kicking region corresponds to a region of the upper that contacts a ball during a predetermined type of kick.

7. The article of footwear according to claim 1, wherein the arc-like configuration corresponds to a curvature of a ball.

8. An article of footwear comprising:

an upper including a ball control portion;

the ball control portion comprising a plurality of protrusions that are configured to bend;

each protrusion of the plurality of protrusions including a major axis, a minor axis, and a normal axis, the normal axis being approximately perpendicular to the major axis and the minor axis;

each protrusion of the plurality of protrusions further including a planar gripping portion that extends in a direction along the major axis and in a direction along the normal axis; and wherein the plurality of protrusions are configured to bend in a manner so that the gripping portions confront a surface of a ball during a kick;

wherein the plurality of protrusions are disposed in an arc-like configuration along an arc extending from a forefoot region of the upper to a midfoot region of the upper;

wherein arc extends from the midfoot region proximate a sole structure of the article of footwear to the forefoot region, the arc also extending in an upward direction as the arc proceeds toward the forefoot region;

wherein adjacent protrusions along the arc are arranged with the major axes of the adjacent protrusions in substantial alignment with each other; and wherein non-adjacent protrusions along the arc are arranged with the major axes of the non-adjacent protrusions in substantial non-alignment with each other.

9. The article of footwear according to claim 1, wherein the arc extends from a forefoot region of the upper to a midfoot region of the upper.

10. The article of footwear according to claim 8, wherein the arc-like configuration corresponds to a curvature of a ball.

11. The article of footwear according to claim 8, wherein the plurality of protrusions are configured to bend in a manner that maximizes surface contact area between the upper and the ball.

12. The article of footwear according to claim 8, wherein the ball control portion is disposed on a medial side of the upper.

13. The article of footwear according to claim 8, wherein the ball control portion is disposed on a lateral side of the upper.

14. The article of footwear according to claim 8, wherein the ball control portion comprises a base portion that is associated with an outer surface of the upper, and wherein the plurality of protrusions are oriented in a generally perpendicular manner to the base portion and the outer surface of the upper.

15. An article of footwear comprising:

an upper including a ball control portion;

the ball control portion comprising a plurality of protrusions that are configured to bend;

each protrusion of the plurality of protrusions including a major axis, a minor axis, and a normal axis, the normal axis being approximately perpendicular to the major axis and the minor axis; and each protrusion of the plurality of protrusions further including a planar gripping portion that extends in a direction along the major axis and in a direction along the normal axis; and wherein the major axes of some protrusions of the plurality of protrusions are aligned with a curve on a surface of a ball when the ball control portion contacts the ball during a kick; wherein the protrusions aligned with the curve on a surface of a ball when the ball control portion contacts the ball during a kick are disposed in an arc-like configuration along an arc extending from a forefoot region of the upper to a midfoot region of the upper;

wherein adjacent protrusions along the arc are arranged with the major axes of the adjacent protrusions in substantial alignment with each other; and wherein non-adjacent protrusions along the arc are arranged with the major axes of the non-adjacent protrusions in substantial non-alignment with each other.

16. The article of footwear according to claim 15, wherein the plurality of protrusions are configured to bend in a manner so that the gripping portion of each protrusion contacts the surface of the ball.

17. The article of footwear according to claim 15, wherein the ball control portion comprises a base portion that is associated with an outer surface of the upper, and wherein the plurality of protrusions are oriented in a generally perpendicular manner to the base portion and the outer surface of the upper.

18. The article of footwear according to claim 17, wherein the base portion comprises a plurality of hub portions connected by a plurality of connecting members.

19. The article of footwear according to claim 18, wherein the plurality of hub portions and connecting members are separated by a plurality of gaps.

20. The article of footwear according to claim 19, wherein the plurality of hub portions and the plurality of gaps have a substantially similar hexagonal shape.

* * * * *